US010977939B2

(12) United States Patent
Zhang et al.

(10) Patent No.: US 10,977,939 B2
(45) Date of Patent: Apr. 13, 2021

(54) VEHICLE-TO-VEHICLE COMMUNICATION CONTROL

(71) Applicant: Ford Global Technologies, LLC, Dearborn, MI (US)

(72) Inventors: Linjun Zhang, Canton, MI (US); Helen Elizabeth Kourous-Harrigan, Monroe, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 148 days.

(21) Appl. No.: 16/362,950

(22) Filed: Mar. 25, 2019

(65) Prior Publication Data

US 2020/0312134 A1 Oct. 1, 2020

(51) Int. Cl.
*G08G 1/09* (2006.01)
*G08G 1/01* (2006.01)

(52) U.S. Cl.
CPC ..... *G08G 1/094* (2013.01); *G08G 1/0116* (2013.01); *G08G 1/0141* (2013.01)

(58) Field of Classification Search
CPC .... G08G 1/094; G08G 1/0141; G08G 1/0116; G08G 1/01; G08G 1/065; G08G 1/07–1/14; H04W 72/02; H04W 72/0486
USPC ..... 340/905
See application file for complete search history.

(56) References Cited

U.S. PATENT DOCUMENTS 6,741,926 B1 * 5/2004 Zhao ..... G01C 21/3492 701/420
8,907,814 B2 * 12/2014 Chen ..... G08G 1/096791 340/905
9,633,560 B1 4/2017 Gao et al.
9,852,637 B2 12/2017 Hayee et al.
10,231,187 B1 * 3/2019 Rubin ..... H04W 4/46
10,237,866 B2 3/2019 Hwang et al.
10,466,716 B1 * 11/2019 Su ..... G06N 3/08
(Continued)

FOREIGN PATENT DOCUMENTS

WO 2017052488 A1 3/2017
WO 2017191615 A1 11/2017
(Continued)

OTHER PUBLICATIONS

Verma et al., "An Analytical Review of the Algorithms Controlling Congestion in Vehicular Networks", I0SR Journal of Computer Engineering (IOSR-JCE), vol. 17, Issue 3, Ver. IV, May-Jun. 2015; www.iosrjournals.org.

*Primary Examiner* — Eric Blount
(74) *Attorney, Agent, or Firm* — Frank A. MacKenzie; Bejin Bieneman PLC

(57) ABSTRACT

An infrastructure element includes a computer that includes a processor and a memory. The memory stores instructions executable by the processor such that the computer is programmed to classify a traffic condition of a road segment based on data received from an object detection sensor with a field of view including the road segment and that is communicatively connected to the computer. The computer is programmed to broadcast, to an area including the road segment, a vehicle-to-vehicle communication parameter, determined based on the classified traffic condition and specifying one or more of (i) a channel identifier, (ii) a transmission rate, (iii) a transmission power, or (iv) a message size.

20 Claims, 4 Drawing Sheets

(56) References Cited

U.S. PATENT DOCUMENTS

| | | | | |
|---|---|---|---|---|
| 2013/0154853 | A1* | 6/2013 | Chen | G08G 1/096741 340/905 |
| 2016/0133130 | A1* | 5/2016 | Grimm | H04W 4/80 340/905 |
| 2018/0158329 | A1 | 6/2018 | Benhammou et al. | |
| 2018/0365909 | A1* | 12/2018 | Cheng | H04L 67/12 |
| 2019/0104525 | A1 | 4/2019 | Santhanam et al. | |
| 2019/0132709 | A1* | 5/2019 | Graefe | H04W 4/38 |
| 2019/0294966 | A1* | 9/2019 | Khan | G06K 9/6267 |

FOREIGN PATENT DOCUMENTS

| | | | |
|---|---|---|---|
| WO | 2018145067 | A1 | 8/2018 |
| WO | 2018187632 | A1 | 10/2018 |
| WO | 2019137622 | A1 | 7/2019 |

* cited by examiner

VEHICLE-TO-VEHICLE COMMUNICATION CONTROL

BACKGROUND

A vehicle can broadcast data about an environment or area around the vehicle via one or more wireless communication networks and/or protocols, e.g., vehicle-to-vehicle (V-TO-V) or vehicle-to-infrastructure (V2X or V2I) communications. Data shared via V-to-V or V2X communications can include data about a condition of infrastructure, (e.g., a defective bridge), traffic speed, a planned lane change, speed change, or other maneuver of another vehicle etc. However, V-to-V and/or V2X communication networks, e.g., available bandwidth for radio frequency (RF) communications, may become congested due to a number of vehicles broadcasting data and/or an amount of information each vehicle broadcasts. Congestion occurs when, e.g., a bandwidth of the communication network is utilized such that a sender of data, e.g., a vehicle computer, cannot access network resources to broadcast data, e.g., insufficient bandwidth is available to transmit one or more packets needed to provide data. Such congestion may cause that a vehicle fails to transmit critical information to other vehicles because of the congestion.

DETAILED DESCRIPTION

Introduction

Figure 1:
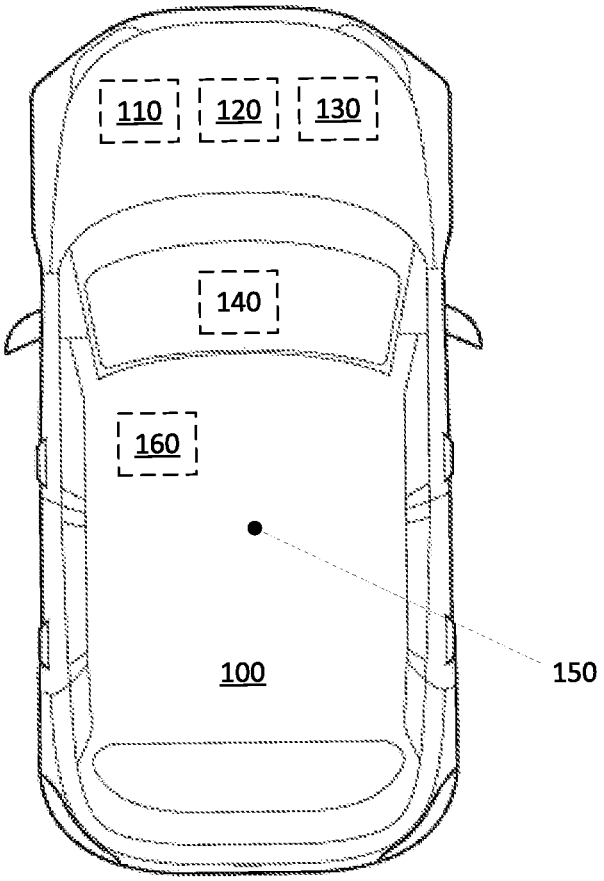
FIG. 1 is a diagram illustrating an example vehicle.

Herein disclosed is an infrastructure element comprising a computer that includes a processor and a memory. The memory stores instructions executable by the processor such that the computer is programmed to classify a traffic condition of a road segment based on data received from an object detection sensor with a field of view including the road segment and that is communicatively connected to the computer, and broadcast, to an area including the road segment, a vehicle-to-vehicle communication parameter, determined based on the classified traffic condition and specifying one or more of (i) a channel identifier, (ii) a transmission rate, (iii) a transmission power, or (iv) a message size.

The instructions may further include instructions to detect one or more vehicles within the road segment, to determine a density and an average speed of the one or more detected vehicles, and to classify, based on the density and the average speed, the traffic condition of the road segment as at least one of normal speed dense traffic, normal speed sparse traffic, low speed sparse traffic, and low speed dense traffic.

The instructions may further include instructions to determine the communication parameter based on classifying the traffic condition.

The instructions may further include instructions to broadcast a segmentation map of a portion of the road within the field of view of the object detection sensor, the segmentation map including (i) a location of each segment on the road, (ii) a traffic condition of each segment, (iii) a communication channel for each segment, and (v) communication parameters for each segment.

The instructions may further include instructions to determine a first and a second channel for a first direction and a second direction of the road, respectively, and a third channel for broadcasting the communication parameters and a segmentation map.

The instructions may further include instructions to determine a fourth and a fifth channel for a second road crossing the road.

The infrastructure element may further comprise a vehicle computer programmed to receive the communication parameter and transmit vehicle-to-vehicle data based on the communication parameter received from the computer and data received from vehicle sensors.

Further disclosed herein is a system including means for classifying a traffic condition of a road segment based on data received from an object detection sensor with a field of view including the road segment, and means for broadcasting to an area including at least the road segment, a vehicle-to-vehicle communication parameter, determined based on the classified traffic condition and specifying one or more of (i) a channel identifier, (ii) a transmission rate, (iii) a transmission power, or (iv) a message size.

The system may further include means for receiving the communication parameter, in a vehicle, and means for transmitting vehicle-to-vehicle data based on the communication parameter received from the computer and data received from vehicle sensors.

Further disclosed herein is a method, comprising classifying, in an infrastructure computer, a traffic condition of a road segment based on data received from an object detection sensor with a field of view including the road segment and that is communicatively connected to the computer, and broadcasting, to an area including the road segment, a vehicle-to-vehicle communication parameter, determined based on the classified traffic condition and specifying one or more of (i) a channel identifier, (ii) a transmission rate, (iii) a transmission power, or (iv) a message size.

The method may further include detecting one or more vehicles within the road segment, determining a density and an average speed of the one or more detected vehicles, and classifying, based on the density and the average speed, the traffic condition of the road segment as at least one of normal speed dense traffic, normal speed sparse traffic, low speed sparse traffic, and low speed dense traffic.

The method may further include determining the communication parameter based on classifying the traffic condition.

The method may further include broadcasting a segmentation map of a portion of the road within the field of view of the object detection sensor, the segmentation map including (i) a location of each segment on the road, (ii) a traffic condition of each segment, (iii) a communication channel for each segment, and (v) communication parameters for each segment.

The method may further include determining a first and a second channel for a first direction and a second direction of the road, respectively, and a third channel for broadcasting the communication parameters and a segmentation map.

The method may further include determining a fourth and a fifth channel for a second road crossing the road.

The method may further include receiving, in a vehicle computer, the communication parameter and transmitting a vehicle-to-vehicle message based on the communication parameter received from the computer and data received from vehicle sensors.

Further disclosed is a computing device programmed to execute any of the above method steps.

Yet further disclosed is a computer program product, comprising a computer readable medium storing instructions executable by a computer processor, to execute any of the above method steps.

Exemplary System Elements

Navigation of vehicles, e.g., autonomous vehicles, drones, robots, etc., may depend on information exchanged via wireless communication networks and/or protocols, e.g., vehicle-to-vehicle (V-to-V) or vehicle-to-infrastructure (V2X or V2I) communications. However, a wireless network may become congested when multiple vehicles within a limited area, e.g., an area with a radius of 1000 meters (m), broadcast information via a communication channel of the wireless network. In the present context, "congestion" occurs when channel bandwidth is substantially (e.g., more than 90%) utilized. For example, a communication channel bandwidth may be 6 Megabit/second (Mb/s). If 250 vehicles within an area each send a message with a size of 2400 bits and a transmission rate of 10 Hz, then the messages utilize an entirety (i.e., 100%) of bandwidth of the communication channel, because 2400 bits*10 Hz*250=6 Mb/s.

Congestion of a wireless communication channel can be detected and prevented or ameliorated by controlling messages broadcast by one or more vehicles. An exemplary system includes an infrastructure element comprising a computer that includes a processor and a memory. A sensor has a field of view including a road segment and is communicatively connected to the computer. The processor can be programmed to classify a traffic condition of the road segment based on data received from the sensor and to broadcast, to an area including the road segment, a vehicle-to-vehicle communication parameter. The parameter is determined based on the classified traffic condition and one or more of (i) a channel identifier, (ii) a transmission rate, (iii) a transmission power, or (iv) a message size or type. Herein, "broadcast" means transmitting data without specifying a receiver.

FIG. 1 illustrates a vehicle 100 which may be powered in a variety of ways, e.g., with an electric motor and/or internal combustion engine. The vehicle 100 may be a land vehicle such as a car, truck, etc. Additionally or alternatively, a vehicle 100 may be a drone, a robot, etc. Additionally or alternatively, the vehicle 100 may include a bicycle, a motorcycle, etc. A vehicle 100 may include a computer 110, actuator(s) 120, sensor(s) 130, and a Human Machine Interface (HMI 140). A reference point such as a geometrical center point 150 can be specified for a vehicle 100, e.g., a point at which respective longitudinal and lateral centerlines of the vehicle 100 intersect.

The computer 110 includes a processor and a memory such as are known. The memory includes one or more forms of computer-readable media, and stores instructions executable by the computer 110 for performing various operations, including as disclosed herein.

The computer 110 may operate the respective vehicle 100 in an autonomous, a semi-autonomous mode, or a non-autonomous (or manual) mode. For purposes of this disclosure, an autonomous mode is defined as one in which each of vehicle 100 propulsion, braking, and steering are controlled by the computer 110; in a semi-autonomous mode the computer 110 controls one or two of vehicles 100 propulsion, braking, and steering; in a non-autonomous mode a human operator controls each of vehicle 100 propulsion, braking, and steering.

The computer 110 may include programming to operate one or more of vehicle 100 brakes, propulsion (e.g., control of acceleration in the vehicle by controlling one or more of an internal combustion engine, electric motor, hybrid engine, etc.), steering, climate control, interior and/or exterior lights, etc., as well as to determine whether and when the computer 110, as opposed to a human operator, is to control such operations. Additionally, the computer 110 may be programmed to determine whether and when a human operator is to control such operations.

The computer 110 may include or be communicatively coupled to, e.g., via a vehicle 100 communications bus as described further below, more than one processor, e.g., controllers or the like included in the vehicle for monitoring and/or controlling various vehicle controllers, e.g., a powertrain controller, a brake controller, a steering controller, etc. The computer 110 is generally arranged for communications on a vehicle communication network that can include a bus in the vehicle such as a controller area network (CAN) or the like, and/or other wired and/or wireless mechanisms.

Via the vehicle 100 network, the computer 110 may transmit messages to various devices in the vehicle and/or receive messages from the various devices, e.g., an actuator 120, an HMI 140, etc. Additionally or alternatively, in cases where the computer 110 actually comprises a plurality of devices, the vehicle 100 communication network may be used for communications between devices represented as the computer 110 in this disclosure. Further, as mentioned below, various controllers and/or sensors may provide data to the computer 110 via the vehicle communication network.

The vehicle 100 actuators 120 are implemented via circuits, chips, or other electronic and or mechanical components that can actuate various vehicle subsystems in accordance with appropriate control signals as is known. The actuators 120 may be used to control braking, acceleration, and steering of a vehicle 100.

The sensors 130 may include a variety of devices such as are known to provide data to the computer 110. For example, the sensors 130 may include Light Detection And Ranging (LIDAR) sensor(s) 130, etc., disposed on a top of the vehicle 100, behind a vehicle 100 front windshield, around the vehicle 100, etc., that provide relative locations, sizes, and shapes of objects surrounding the vehicle 100. As another example, one or more radar sensors 130 fixed to vehicle 100 bumpers may provide data to provide locations of the objects, second vehicles 100, etc., relative to the location of the vehicle 100. The sensors 130 may further alternatively or additionally include camera sensor(s) 130, e.g. front view, side view, etc., providing images from an area surrounding the vehicle 100.

The HMI 140 may be configured to receive input from a human operator during operation of the vehicle 100. Moreover, an HMI 140 may be configured to display, e.g., via visual and/or audio output, information to the user. Thus, an HMI 140 may be located in the passenger compartment of the vehicle 100 and may include one or more mechanisms for user input.

The computer 110 may be programmed to receive a destination, e.g., location coordinates, via the HMI 140, and to determine a route from a current location of the vehicle 100 to the received destination. The computer 110 may be programmed to operate the vehicle 100 in an autonomous mode from the current location to the received destination based on the determined route.

The computer 110 may be configured for communicating through a vehicle-to-vehicle (V-to-V) wireless communication interface 160 with other vehicles 100, e.g., via a vehicle-to-vehicle communication. The communication interface 160 may include elements for sending (i.e., transmitting) and receiving radio frequency (RF) communications, e.g., chips, antenna(s), transceiver(s), etc. The V-to-V communication represents one or more mechanisms by which vehicle 110 computers 110 may communicate with other vehicles 100 and/or infrastructure element 205 computers 210 (see FIG. 2), and may be one or more of wireless communication mechanisms, including any desired combination of wireless and wired communication mechanisms and any desired network topology (or topologies when a plurality of communication mechanisms are utilized). Exemplary V-to-V communication protocols include cellular, Bluetooth, IEEE 802.11, dedicated short-range communications (DSRC), and/or wide area networks (WAN), including the Internet, providing data communication services. DSRC may have one-way or two-way short-range to medium-range wireless communication channels.

In an example, the vehicle 100 computer 110 may broadcast messages based on a V-to-V communication protocol, e.g., DSRC, to other vehicles 100. The computer 110 may be programmed to receive data from vehicle 100 sensors 130, other computers 110, controllers, etc., to generate a V-to-V message, and to broadcast the V-to-V message via the communication interface 160. Table 1 shows an example set of data that may be included in a V-to-V message. In one example, a V-to-V message may include a header and any combination of message content corresponding to identifiers ($SC_1$, $SC_2$, $SC_3$ in the example of Table 1) that specify content for the message, i.e., that convey meaning according to a description or definition provided for the content identifier. For example, a message including an identifier $SC_1$ includes data content such as current vehicle 100 state, position, etc. In other words, inclusion of identifier $SC_1$, $SC_2$, $SC_3$ in a message indicates content of data in the message that is associated with each of the included identifiers $SC_1$, $SC_2$, $SC_3$.

TABLE 1

| Message content identifier | Description |
|---|---|
| Header | Protocol-specific data such as an identifier of the sender, timestamp, etc. |
| $SC_1$ | Current vehicle state, e.g., position, velocity, acceleration |
| $SC_2$ | Current vehicle operational status, e.g., the status of the automatic emergency brake, anti-lock brake system (ABS), electronic stability control (ESC). |
| $SC_3$ | Planned vehicle state, e.g., planned acceleration, position, velocity, a planned lane change maneuver, a planned turn right/left maneuver. |

The vehicle computer 110 may be programmed to transmit a message based on a set of one or more communication parameters C. Table 2 shows an exemplary set of communication parameters C. For example, the computer 110 may be programmed to determine a transmission power P, transmission rate R, message size S, and a broadcast channel number $N_b$ based on data stored in a computer 110 memory. Additionally or alternatively, as discussed below with reference to FIG. 2, the computer 110 can be programmed to determine the channel number $N_b$ for broadcasting, based on data received via a channel $N_c$ from a remote computer.

TABLE 2

| Communication parameter C | Description |
|---|---|
| P | P represents an amount of electromagnetic power, e.g., specified in decibel milliwatt (dBm). The computer 110 may actuate the communication interface 160 to radiate the power P for transmitting the V-to-V message. |
| R | R represents a rate of transmission of a V-to-V message, e.g., specified in message per second (msg/sec), Hertz (Hz), etc. |
| S | S represents a message type and/or size. With respect to example Table 1, a message S may be adjusted based on a combination of message contents $SC_1$, $SC_2$, $SC_3$. Additionally or alternatively, S may specify a maximum number of data bytes that can be included in a broadcast message. In the present context, a type of the message may be a vehicle motion state, vehicle status, planned future state, etc. |
| $N_b$ | A wireless communication protocol, e.g., DSRC, may include a plurality of channels for communication (or broadcast channel). $N_b$ represents a channel identifier such as a channel number via which vehicle broadcasts message(s), i.e., V-to-V data. In one example, DSRC implementation may have channels with channel numbers from 172 to 184. |
| $N_c$ | $N_c$ represents a channel identifier for a control channel, i.e., a channel through which the vehicles receive instructions from a remote computer such as the infrastructure element computer. |

Figure 2:
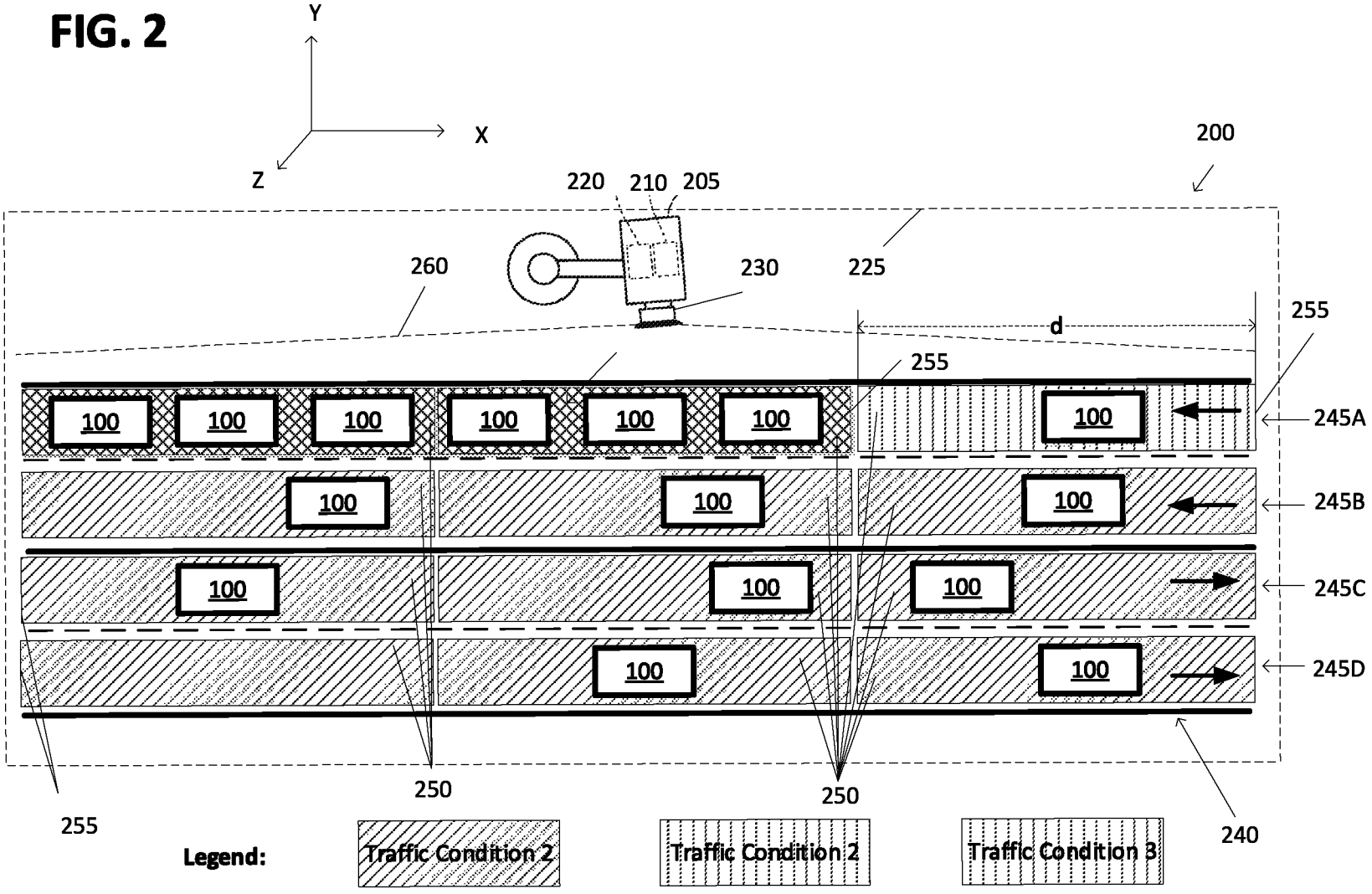
FIG. 2 is a diagram showing an infrastructure element and vehicles driving on a road.

FIG. 2 shows a system 200 including a plurality of vehicles 100 and an infrastructure element 205 including a computer 210, a wireless communication interface 220, and a sensor 230.

The computer 210 (or infrastructure computer 210) includes a processor and a memory such as are known. The memory includes one or more forms of computer-readable media, and stores instructions executable by the computer 210 for performing various operations, including as disclosed herein. The computer 210 may be configured for communicating through a wireless communication interface 220 with vehicles 100 via a V-to-V communication protocol, e.g., a DSRC network. The communication interface 220 may include chips, antenna(s), transceiver(s), etc. The communication interface 220 may have a communication coverage area (or area 225). Area 225, in the present context, is an area in which the computer 210 can communicate with another computer, e.g., a vehicle 100 computer 110. Dimensions and/or shape of area 225 is typically based on a communication technique, communication frequency, communication power, etc., of the communication interface 220, as well as environmental factors, the topography of the area 225, etc. In one example, area 225 is a circle centered at a location of the infrastructure element 205 with a radius of 1000 meters.

Infrastructure sensor(s) 230 may include one or more sensors that provide data by which objects can be detected, e.g., camera, Lidar (Light imaging detection and ranging), radar, etc. The computer 210 may be programmed to receive data from the sensor 230, and to detect objects such as vehicles 100, buildings, lane markings, etc., on a road 240 using image processing and/or depth-detection techniques. Typically, the communication coverage area 225 includes an area covered by the field of view 260 of the sensor(s) 230.

Note that a communication range of an interface 220 may include an area larger than a field of view 260 of sensor(s) 230.

The computer 210 may be programmed to determine location coordinates of detected vehicles 100 with reference to, e.g., axes of a three-dimensional Cartesian coordinate system, e.g., where a horizontal X-Z plane is defined along with vertical X-Y and Z-Y planes, the planes and respective axes being orthogonal to one another. An origin, i.e., intersection of all three axes, of the coordinate system could be at, e.g., a reference location of GPS (Global Positioning System) coordinates system. In one example, the computer 210 may identify two-dimensional (2D) location coordinates of a land vehicle 100 on the ground surface with respect to horizontal axes of the three-dimensional coordinate system. In another example, the computer 210 may be programmed to identify 3D location coordinates of an aerial vehicle 100 with reference to all three axes of the three-dimensional coordinate system.

The infrastructure element 205 is placed, typically permanently fixed, at a location in an area 225, e.g., mounted to various non-moving objects, poles, etc. Thus, a field of view 260 is specified based on a location and orientation (i.e., with respect to a three-dimensional coordinate system) of the sensor 130 on the infrastructure element 205. A field of view 260 can include a ground surface area, e.g., an area defined by a road 240 segment 250. As shown in FIG. 2, a field of view 260 can include an area of a road 240 having lane(s) 245A, 245B, 245C, 245D including one or more segments 250. Depending on dimensions of the field of view 260 of the sensor 130 and dimensions of segments 250, the field of view 260 may include a plurality of segments 250. Road(s) 240 may be two-way (as shown in FIG. 2) or one-way. Roads 240 may have one or more lanes 245A, 245B, 245C, 245D in each direction, e.g., lanes 245A, 245B in a first direction and lanes 245C. 245D for a second direction opposite to the first direction. Although not illustrated, a field of view 260 could include multiple, e.g., intersecting, roads 240.

The infrastructure element 205 computer 210 may be programmed to classify a traffic condition of a road 240 segment 250 based on data received from an object detection sensor 230 with a field of view 260 including the road 240 segment 250. The computer 210 can be programmed to broadcast, to the communication area 225 including the road 240 segment 250, a vehicle-to-vehicle communication parameter C set, determined based on the classified traffic condition and specifying one or more of (i) a channel identifier $N_b$, (ii) a transmission rate R, (iii) a transmission power P, or (iv) a message size S.

In the present context, a road 240 segment 250 is a portion of one or more of road 240 lanes 245A, 245B, 245C, 245D within the field of view 260 of the sensor 230. In one example, shown in FIG. 2, each segment 250 includes a portion of a lane 245A, 245B, 245C, 245D with a length d, e.g., 50 meters, in a direction. Additionally or alternatively, segments 250 may have different lengths d and/or width (i.e., number of adjacent lanes 245A, 245B, 245C, 245D included in a segment 25). A segment 250 may have a rectangular or curved shape based on a curvature of the road 240. A segment 250 may be identified by a lane 245A, 245B, 245C, 245D location, e.g., based on map data received from a remote computer, location coordinates of a start point 255 of the segment 250, and/or the segment 250 length d. Thus, a perimeter of the segment 250 may be determined based on lane 245A, 245B, 245C, 245D edges, start point 255 and length d with respect to the three-dimensional Cartesian coordinate system mentioned above. In the present context, the start point 255 is a point of the segment 250 determined based on a specified direction for vehicle 100 movement. Start point 255 of a segment 250 is a point which is driven over by a vehicle 100 at first upon entering the respective segment 250. In one example, location coordinates of the start point 255 may be location coordinates of a point located laterally in a middle of the lane 245A, 245B, 245C, 245D. Here should be noted, that for improved legibility, only some of start points 255 are numbered in FIG. 2.

In the present condition, a "traffic condition" of a segment 250 is a set of data including an average speed and a density of vehicle 100, e.g., a segment density p and an average speed v of vehicles 100 in a segment 250. In the present context, "classifying" means determining a classification Q for a segment 250. A classification Q may be one of a group of classifications, such as normal-speed dense traffic, low-speed dense traffic, etc., and/or specified as with a number within a range, e.g., a percentage. The computer 210 may classify the traffic condition by determining a classification Q. Table 3 shows an example set of rules to determine a traffic condition classification Q based on a density p and an average speed v. In the present context, segment density p is specified as a number of vehicles 100 per specified distance, e.g., 120 veh/km. Thus, the density p may be determined by dividing the number of vehicles 100 located within perimeter of a segment 250 into the length, i.e., distance, d of the segment 250. Additionally or alternatively, a segment 250 density p may be specified in vehicles per second, e.g., a number of vehicles 100 entering a segment 250 per second.

TABLE 3

| Traffic condition classification Q | Average Speed v (unit: kph) | Density ρ (vehicles per kilometer) |
|---|---|---|
| normal-speed dense traffic | Greater than 8 | Greater than 120 |
| normal-speed sparse traffic | Greater than 8 | Less than 120 |
| low-speed dense traffic | Less than 8 | Greater than 120 |
| low-speed sparse traffic | Less than 8 | Less than 120 |

The computer 210 may be programmed to detect the vehicle(s) 100, and to determine the segment 250 density p based on a number of detected vehicles 100 in a segment 250. The computer 210 may determine a number of vehicles 100 in the segment 250 based on whether determined location coordinates of the vehicles 100 are within location coordinates of the segment 250, i.e., are within a boundary defining the segment 250. The computer 210 may determine the segment 250 density p based on the identified number of vehicles 100 in the segment 250 and a length d of the segment 250. A vehicle 100 having a 3D location coordinates, e.g., a drone, is within a segment 250 when a projection of the vehicle 100 location on the ground surface, i.e., x, y coordinates of the drone vehicle 100, is likewise within boundaries of the segment 250.

In one example, the computer 210 may be programmed, in accordance with a table, e.g., in the form of Table 3 below, to classify the traffic condition of a segment 250 by determining a traffic condition classification Q, e.g., normal speed dense traffic, normal speed sparse traffic, low speed sparse traffic, and low speed dense traffic, based on the average speed v and densify p of the respective segment 250. Additionally or alternatively, the classification Q may be specified in a range, e.g., 1 (no congestion) to 10 (non-moving traffic jam).

In one example, the computer 210 may be programmed to determine an average speed v of a segment 250 based on Equation (1). Thus, the computer 210 may detect k vehicles 100 within a segment 250. The computer 210 may determine a speed $v_i$ of each of the vehicles 100 and determine the average speed v based on the vehicles 100 number k and speed $v_i$ of each of the vehicles 100.

$$v = \frac{1}{k}\sum_{i=1}^{k} v_k \tag{1}$$

As discussed above, computer 210 can be programmed to determine the communication parameter C, e.g., Table 2, for a segment 250 and broadcast the determined communication parameter for segment 250.

In one example, the computer 210 may be programmed to determine the communication parameter C for a segment 250 based on the determined traffic condition classification Q of the segment 250. A lookup table or the like, e.g., as illustrated in Table 4 below, can specify example communication parameter(s) C for corresponding to respective quantifiers Q, as specified by Table 3. For example, upon determining a classification Q to be "low-speed dense traffic", the computer 210 may be programmed to determine a transmission rate R of 1 Msg/sec, transmission power of 4 dBm and a message size S at most including current vehicle state $SC_1$ and current vehicle status $SC_2$.

TABLE 4

| Traffic condition classification Q | Tx rate R (Msg/sec) | Tx Power P (dBm) | Message type or size S |
|---|---|---|---|
| normal-speed dense traffic | 5 | 12 | SC1, SC2 |
| normal-speed sparse traffic | 10 | 20 | SC1, SC2, SC3 |
| low-speed dense traffic | 1 | 4 | SC1, SC2 |
| low-speed sparse traffic | 10 | 20 | SC1, SC2, SC3 |

In yet another example, in contrast to determining the transmission rate R and the power P based on tables such as Table 3-4, the computer 210 may be programmed, based on Equation(s) (2)-(3), to determine the transmission rate R and the power P for the segment(s) 250 based on the determined density p. As stated in Table 2, the power P may be specified in dBm which may be equivalent to 10 milliwatt (mW). Thus, with reference to Equation (3), a value 0 (zero) for the power P indicates a broadcast with a low power level of 0 dBm, e.g., to a very limited area around the broadcasting vehicle 100. $V_{max}$ represents a speed limit for the respective segment 250, e.g., determined based on map data.

$$R = \begin{cases} 1, & \rho > \rho_{th} \\ \dfrac{rv}{v_{max}(q\rho + o)}, & \rho \le \rho_{th} \end{cases} \tag{2}$$

$$P = \begin{cases} 0, & \rho > \rho_{th} \\ \dfrac{kv}{v_{max}(\rho + c)}, & \rho \le \rho_{th} \end{cases} \tag{3}$$

With respect to Equation (2), q denotes a weight parameter, e.g., with a unit km/vehicle, e.g., 0.05 km/vehicle, and o is an offset parameter with no unit limit, e.g., 1. Herein, $p_{th}$ is a density threshold, e.g., 150 vehicle/km. In one example, in order to achieve transmission rates R less than a maximum threshold $R_{max}$, e.g., 20 msg/sec, parameters r and o may be determined based on equations (4) and inequality (5). Parameter q denotes a weight, e.g., with a unit of kilometer/vehicles, which may indicate a desired average space (length of road) between vehicles. Parameter o is a constant offset.

$$r = R_{max} \tag{4}$$

$$o \ge 1 - qp \tag{5}$$

As discussed above, the computer 110 of a vehicle 100 may be programmed to broadcast V-to-V data (e.g., messages) via the V-to-V wireless network. The computer 110 may be programmed to receive the communication parameter C such as transmission rate R, power P, and/or message size S of a segment 250 broadcasted by the infrastructure element 205, and to transmit a V-to-V message according to specification(s) of the received communication parameter(s) C and including data from vehicle 100 sensors 130, upon determining that the vehicle 100 is in the respective segment 250.

The vehicle 100 computer 110 may be programmed to actuate the communication interface 160 to transmit a V-to-V message in accordance with the transmission rate R and the power P. The computer 110 may be programmed to determine a V-to-V message's data content based on the received communication parameter C. For example, upon receiving a communication parameter C including message content identifiers $SC_1$ and $SC_2$, the computer 110 may be programmed to exclude planned vehicle state $SC_3$ from the broadcasted V-to-V message. In other words, the computer 110 may be programmed to adjust the message size S to comply with the received communication parameter C.

The vehicle 100 computer 110 may be programmed to determine whether the vehicle 100 is within a segment 250 based on data received from the infrastructure element 205 and vehicle 100 location data, e.g., location coordinates received from a vehicle 100 location sensor 130 such as a GPS (General Positioning Sensor). The computer 210 of the infrastructure element 205 may be programmed to broadcast a segmentation map that specifies a location of segments 250 and communication parameter C for each mapped segment 250. The infrastructure element 205 computer 210 may be programmed to broadcast a segmentation map of a portion of the road 240 within the field of view 260 of the sensor 230. The segmentation map may include (i) a location of each segment 250 on the road 240, (ii) a traffic condition of each segment, (iii) a communication channel $N_b$ for each segment 250, and (v) communication parameters C for each segment.

Table 5 shows an example segmentation map for m segments within the field of view 260. Each row of Table 5 may include information corresponding to one segment 250 in the field of view 260. For example, the segmentation map may include location coordinates of segment 250 start point 255 and length d of the segment 250. Segments 250 may have same length d or different lengths $d_1, \ldots, d_m$. The segmentation map may include traffic conditions of each segment 250, e.g., density $p_1 \ldots p_m$, average speed $v_1 \ldots v_m$, and/or classification $Q_1 \ldots Q_m$. Each row may include a set of one or more communication parameters denoted by $C_1 \ldots C_m$. A set of communication parameters $C_i$ may include at least one of transmission rate $T_i$, power $P_i$, message size $S_i$, broadcast channel number $Nb_i$.

TABLE 5

| Segment identifier | Segment start point location | Segment length | Traffic condition | Communication parameter |
|---|---|---|---|---|
| $id_1$ | $x_1$, $y_1$ | $d_1$ | $\rho_1$, $v_1$, $Q_1$ | $C_1$ |
| . . . | | | | |
| $id_i$ | $x_i$, $y_i$ | $d_i$ | $\rho_i$, $v_i$, $Q_i$ | $C_i$ |
| . . . | | | | |
| $id_m$ | $x_m$, $y_m$ | $d_m$ | $\rho_1$, $v_1$, $Q_1$ | $C_m$ |

With reference to Tables 4-5, a message size $S_i$ may specify message content that is allowed for broadcast by vehicles 100 located in or on the segment 250 having the respective identifier $id_i$. For example, if $S_i$={SC1, SC2}, then a vehicle 100 computer 110 located within the segment 250 with identifier $id_1$ may at most broadcast message contents identified by identifiers SC1 and SC2 (i.e., no future state data such as lane change data).

With reference to Table 5, the segmentation map may include a broadcast channel for each segment 250, e.g., a channel $Nb_i$ for a segment 250 having a respective identifier $id_i$. Thus, the computer 110 of the vehicle 100 may be programmed to, upon determining that the vehicle 100 is in the respective segment 250 having an identifier $id_i$, broadcast V-to-V message's data on the channel $Nb_i$.

As discussed above, the computer 210 of the infrastructure element 205 may determine a broadcast channel number $Nb_i$ for each segment 250. In one example, the computer 210 may be programmed to determine a same broadcast channel number for segments 250 on a lane 245A, 245B, 245C, 245D in a given direction. For example, with reference to FIG. 2, the computer 210 may be programmed to determine a same broadcast channel number $Nb_i$ for each of the segments 250 along the lane 245A within a field of view 260. V-to-V data broadcast by vehicles 100 moving on opposite direction lanes 245A, 245B, 245C, 245D may be irrelevant to one another. Thus, in one example, the computer 210 may be programmed to determine a first and a second channel $Nb_i$ for a first direction and a second direction of the road 240, respectively, and a third control channel Nc for broadcasting the communication parameters $C_i$ and the segmentation map. The vehicle 100 computer 110 may be programmed to receive the segmentation map via control channel Nc and to broadcast the V-to-V message based on the received segmentation map and vehicle 100 location, i.e., based on determining whether and in which segment 250 of the map the vehicle 100 is located.

The computer 210 may be programmed to determine different broadcast channel numbers for different roads 240 and/or lanes 245A, 245B, 245C, 245D. In one example, the computer 210 could determine a first broadcast channel number $Nb_i$ for the lanes 245A, 245B, a second broadcast channel number $Nb_i$ for the lanes 245C, 245D, a fourth and a fifth channel for a second road 240 crossing the road 240.

Figure 3:
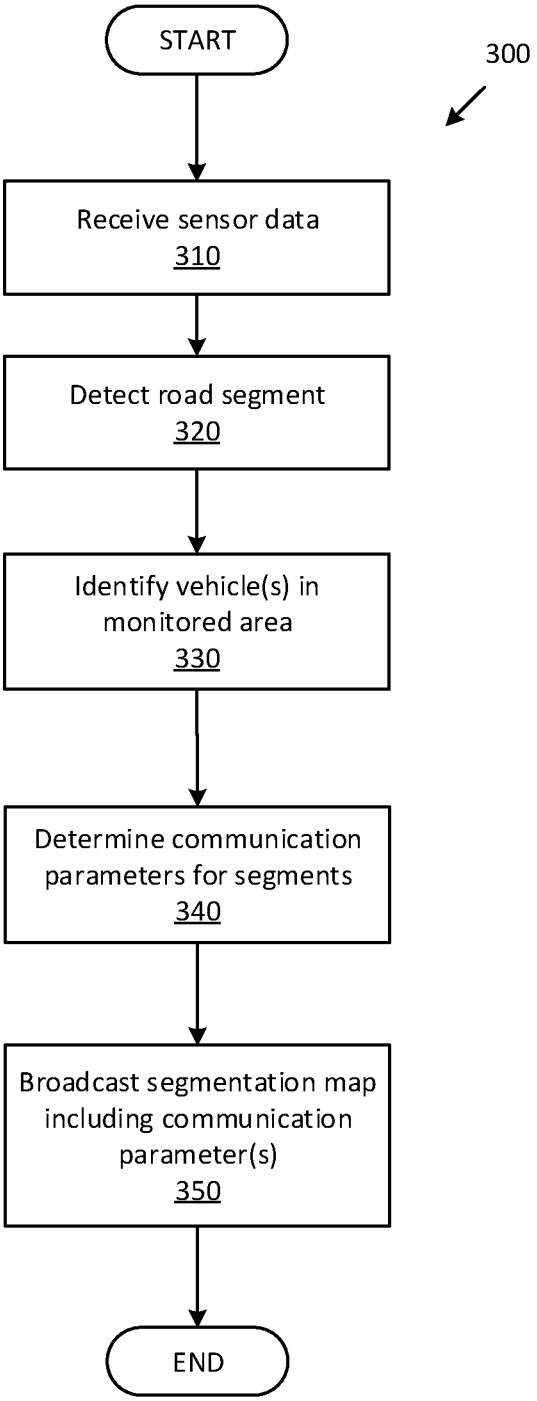
FIG. 3 is a flowchart of an exemplary process for controlling vehicle-to-vehicle (V-to-V) communication.

FIG. 3 is a flowchart of an exemplary process 300 for controlling vehicle-to-vehicle (V-to-V) communication(s). For example, the infrastructure element 205 computer 210 may be programmed to execute one or more blocks of the process 300.

The process 300 begins in a block 310, in which the computer 210 receives sensor 230 data, e.g., from a camera sensor 230, Lidar sensor 230, etc.

Next, in a block 320, the computer 210 determines the road 240 segments 250. In one example, the infrastructure element 205 and the field of view 260 of the sensor(s) 230 may be non-moving. The location of segments 250, e.g., the location coordinates of boundaries of each segment 250, the length d of the segments 250, etc., may be stored in a computer 210 memory. Additionally or alternatively, the computer 210 may be programmed to determine the segments 250 data based on received image data from the camera sensor 230 and stored information concerning location coordinates and a direction of the sensor 230 field of view 260.

Next, in a block 330, the computer 210 detects vehicle(s) 100 in the field of view 260. The computer 210 may be programmed to detect vehicle(s) 100 based on object data received from the sensor(s) 230. The computer 210 may be programmed to determine whether a vehicle 100 is detected in the field of view 260 and, if a vehicle 100 is detected, to then determine location coordinates, speed, etc., of the detected vehicle(s) 100. As discussed above, the computer 210 may be programmed to determine a vehicle 100 location based on stored location of the infrastructure element 205 and field of view 260 of the sensor 230. Thus, the computer 210 may be programmed to determine the number of vehicles 100 detected for each of the segments 250 and the respective speed of each vehicle 100. The computer 210 may be further programmed to determine a density p and an average speed v of vehicles 100 for each segment 250 based on the detected vehicles 100, as discussed above.

Next, in a block 340, the computer 210 determines communication parameter(s) for each segment 250, e.g., communication parameter $C_i$ for segment 250 with identifier $id_i$. In one example, the computer 210 may be programmed to determine a traffic condition classification $Q_i$ for the segment 250, e.g., based on Table 3, and to determine the communication parameter $C_i$ based on the determined classification $Q_i$, e.g., based on Table 4. In another example, the computer 210 may be programmed, e.g., according to Equations (2)-(3) to determine the communication parameter $C_i$ based on the determined density p and/or average speed v of each segment 250.

Next, in a block 350, the computer 210 broadcasts the segmentation map including the communication parameter(s) $C_i$. In one example, the computer 210 may be programmed to broadcast the segmentation map, e.g., including data such as shown in Table 5, via the control channel $N_c$.

Following the block 350, the process 300 ends, or alternatively returns to the block 310, although not shown in FIG. 3.

Figure 4:
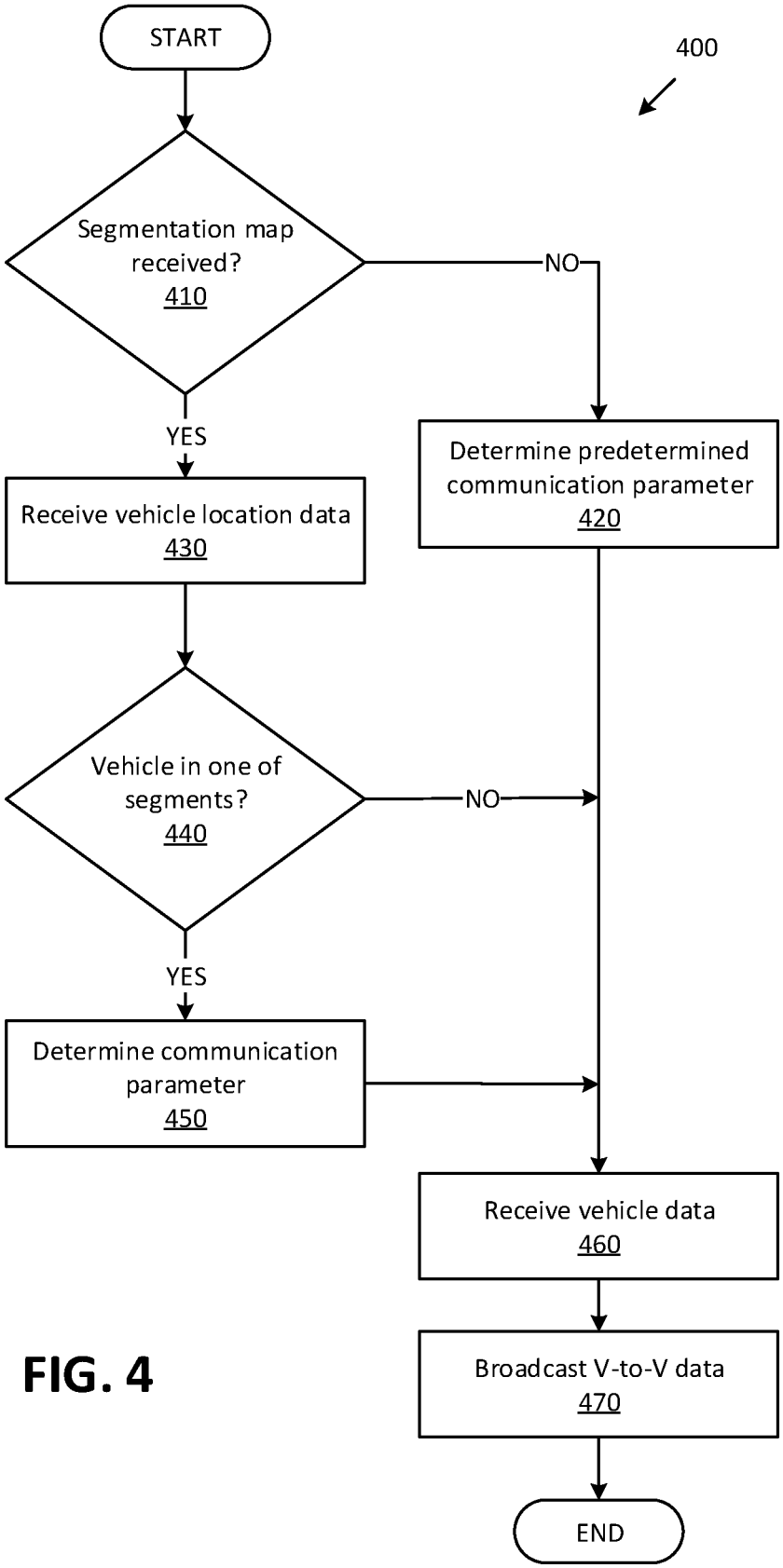
FIG. 4 is a flowchart of an exemplary process for operating a vehicle V-to-V communication.

FIG. 4 is a flowchart of an exemplary process 400 for V-to-V communication. For example, the vehicle 100 computer 110 may be programmed to execute blocks of the process 400.

The process 400 begins in a decision block 410, in which the computer 110 determines whether a segmentation map is received. In one example, the computer 110 may be programmed to determine whether the segmentation map including the communication parameter $C_i$ is received, e.g., via the wireless communication control channel $N_c$. In one example, the control channel number $N_c$ may be stored in the computer 110 memory. If the computer 110 determines that the segmentation map is received, then the process 400 proceeds to a block 430; otherwise the process 400 proceeds to a block 420.

In the block 420, the computer 110 determines the communication parameter C, e.g., based on data stored in the computer 110 memory. In one example, the computer 110 memory may store specified transmission rate R, power P, and/or message size S. For example, the stored information may be based on previously received segmentation map.

In the block 430, the computer 110 receives vehicle 100 location data. For example, the computer 110 may be programmed to determine vehicle 100 location based on location coordinates data received from a vehicle 100 GPS sensor 130 with reference to a GPS coordinates system.

Next, in a decision block 440, the computer 110 determines whether the vehicle 100 is within a segment 250. The computer 110 may be programmed to determine whether the vehicle 100 is within a segment 250 based on location data of the respective segment 250, e.g., start point 255 location coordinates, length d of the segment 250, etc., and the vehicle 100 location data, e.g., GPS location coordinates. If the computer 110 determines that the vehicle 100 is within a segment 250, e.g., with identifier $id_i$, then the process 400 proceeds to a block 450; otherwise the process 400 proceeds to a block 460.

In the block 450, the computer 110 determines the communication parameter for the vehicle 100 based on the determined segment 250. The computer 110 may be programmed to determine communication parameter $C_i$ based on the determined identifier $id_i$ of the segment 250 in which the vehicle 100 is determined to be located.

Next, in a block 460, the computer 110 receives vehicle 100 data. The computer 110 may be programmed to receive vehicle 100 data from vehicle 100 sensors 130, other computers in the vehicle 100, data stored in the computer 110, etc. Vehicle 100 data may include data corresponding to message contents such as current state SC1, a current status of operation SC2 and/or future (or planned) state SC3 of the vehicle 100.

Next, in a block 470, the computer 110 broadcasts V-to-V data based on the determined communication parameter $C_i$ and the received vehicle 100 data. The computer 110 may identify message content based on received message size $S_i$. For example, if $S_i$ includes SC1 and SC2, then the computer 110 may omit any future state data such as planned lane change data from broadcast V-to-V messages. The computer 110 may actuate the vehicle 100 wireless communication interface 160 to broadcast V-to-V data based on the received transmission rate $R_i$ and the power $P_i$.

Following the block 470, the process 400 ends, or alternatively returns to the decision block 410, although not shown in FIG. 4.

The article "a" modifying a noun should be understood as meaning one or more unless stated otherwise, or context requires otherwise. The phrase "based on" encompasses being partly or entirely based on.

Computing devices as discussed herein generally each include instructions executable by one or more computing devices such as those identified above, and for carrying out blocks or steps of processes described above. Computer-executable instructions may be compiled or interpreted from computer programs created using a variety of programming languages and/or technologies, including, without limitation, and either alone or in combination, Java™, C, C++, Visual Basic, Java Script, Perl, HTML, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media. A file in the computing device is generally a collection of data stored on a computer readable medium, such as a storage medium, a random-access memory, etc.

A computer-readable medium includes any medium that participates in providing data (e.g., instructions), which may be read by a computer. Such a medium may take many forms, including, but not limited to, non-volatile media, volatile media, etc. Non-volatile media include, for example, optical or magnetic disks and other persistent memory. Volatile media include dynamic random-access memory (DRAM), which typically constitutes a main memory. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH, an EEPROM, any other memory chip or cartridge, or any other medium from which a computer can read.

With regard to the media, processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of systems and/or processes herein are provided for the purpose of illustrating certain embodiments, and should in no way be construed so as to limit the disclosed subject matter.

Accordingly, it is to be understood that the present disclosure, including the above description and the accompanying figures and below claims, is intended to be illustrative and not restrictive. Many embodiments and applications other than the examples provided would be apparent to those of skill in the art upon reading the above description. The scope of the invention should be determined, not with reference to the above description, but should instead be determined with reference to claims appended hereto and/or included in a non-provisional patent application based hereon, along with the full scope of equivalents to which such claims are entitled. It is anticipated and intended that future developments will occur in the arts discussed herein, and that the disclosed systems and methods will be incorporated into such future embodiments. In sum, it should be understood that the disclosed subject matter is capable of modification and variation.

What is claimed is:

1. An infrastructure element comprising a computer that includes a processor and a memory, the memory storing instructions executable by the processor such that the computer is programmed to:

classify a traffic condition of a road segment based on data received from an object detection sensor with a field of view including the road segment and that is communicatively connected to the computer; and broadcast, to an area including the road segment, a vehicle-to-vehicle communication parameter, determined based on the classified traffic condition, wherein the vehicle-to-vehicle communication parameter specifies one or more of (i) a channel identifier, (ii) a transmission rate, or (iii) a message size.

2. The infrastructure element of claim 1, wherein the instructions further include instructions to:

detect one or more vehicles within the road segment;

determine a density and an average speed of the one or more detected vehicles; and classify, based on the density and the average speed, the traffic condition of the road segment as at least one of normal speed dense traffic, normal speed sparse traffic, low speed sparse traffic, and low speed dense traffic.

3. The infrastructure element of claim 2, wherein the instructions further include instructions to determine the communication parameter based on classifying the traffic condition.

4. The infrastructure element of claim 1, wherein the instructions further include instructions to broadcast a segmentation map of a portion of the road within the field of view of the object detection sensor, the segmentation map including (i) a location of each segment on the road, (ii) a traffic condition of each segment, (iii) a communication channel for each segment, and (iv) communication parameters for each segment.

5. The infrastructure element of claim 1, wherein the instructions further include instructions to determine a first and a second channel for a first direction and a second direction of the road, respectively, and a third channel for broadcasting the communication parameters and a segmentation map.

6. The infrastructure element of claim 5, wherein the instructions further include instructions to determine a fourth and a fifth channel for a second road crossing the road.

7. The infrastructure element of claim 1, further comprising a vehicle computer programmed to receive the communication parameter and transmit vehicle-to-vehicle data based on the communication parameter received from the computer and data received from vehicle sensors.

8. A method, comprising:

classifying, in an infrastructure computer, a traffic condition of a road segment based on data received from an object detection sensor with a field of view including the road segment and that is communicatively connected to the computer; and broadcasting, to an area including the road segment, a vehicle-to-vehicle communication parameter, determined based on the classified traffic condition, wherein the vehicle-to-vehicle communication parameter specifies one or more of (i) a channel identifier, (ii) a transmission rate, or (iii) a message size.

9. The method of claim 8, further comprising:

detecting one or more vehicles within the road segment;

determining a density and an average speed of the one or more detected vehicles; and classifying, based on the density and the average speed, the traffic condition of the road segment as at least one of normal speed dense traffic, normal speed sparse traffic, low speed sparse traffic, and low speed dense traffic.

10. The method of claim 9, further comprising determining the communication parameter based on classifying the traffic condition.

11. The method of claim 8, further comprising broadcasting a segmentation map of a portion of the road within the field of view of the object detection sensor, the segmentation map including (i) a location of each segment on the road, (ii) a traffic condition of each segment, (iii) a communication channel for each segment, and (iv) communication parameters for each segment.

12. The method of claim 8, further comprising determining a first and a second channel for a first direction and a second direction of the road, respectively, and a third channel for broadcasting the communication parameters and a segmentation map.

13. The method of claim 12, further comprising determining a fourth and a fifth channel for a second road crossing the road.

14. The method of claim 8, further comprising receiving, in a vehicle computer, the communication parameter and transmitting a vehicle-to-vehicle message based on the communication parameter received from the computer and data received from vehicle sensors.

15. An infrastructure element comprising a computer that includes a processor and a memory, the memory storing instructions executable by the processor such that the computer is programmed to:

detect one or more vehicles within a road segment based on data received from an object detection sensor with a field of view including the road segment and that is communicatively connected to the computer;

determine a density and an average speed of the one or more detected vehicles;

classify, based on the density and the average speed, the traffic condition of the road segment; and broadcast, to an area including the road segment, a vehicle-to-vehicle communication parameter, determined based on the classified traffic condition and specifying one or more of (i) a channel identifier, (ii) a transmission rate, (iii) a transmission power, or (iv) a message size.

16. The infrastructure of claim 15, wherein the instructions further include instructions to classify the traffic condition of the road segment as at least one of normal speed dense traffic, normal speed sparse traffic, low speed sparse traffic, and low speed dense traffic.

17. The infrastructure element of claim 16, wherein the instructions further include instructions to determine the communication parameter based on classifying the traffic condition.

18. The infrastructure element of claim 15, wherein the instructions further include instructions to broadcast a segmentation map of a portion of the road within the field of view of the object detection sensor, the segmentation map including (i) a location of each segment on the road, (ii) a traffic condition of each segment, (iii) a communication channel for each segment, and (iv) communication parameters for each segment.

19. The infrastructure element of claim 15, wherein the instructions further include instructions to determine a first and a second channel for a first direction and a second direction of the road, respectively, and a third channel for broadcasting the communication parameters and a segmentation map.

20. The infrastructure element of claim 15, further comprising a vehicle computer programmed to receive the communication parameter and transmit vehicle-to-vehicle data based on the communication parameter received from the computer and data received from vehicle sensors.

* * * * *